US009870733B2

(12) United States Patent
Chun et al.

(10) Patent No.: US 9,870,733 B2
(45) Date of Patent: Jan. 16, 2018

(54) DATA SIGNAL PROCESSING DEVICE AND DISPLAY DEVICE HAVING THE SAME

(71) Applicant: SAMSUNG DISPLAY CO., LTD., Yongin, Gyeonggi-Do (KR)

(72) Inventors: Byung-Ki Chun, Seoul (KR); Jae-Shin Kim, Seoul (KR); Jeong-Hun So, Hwaseong-si (KR); Won-Woo Jang, Seoul (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 60 days.

(21) Appl. No.: 14/700,719

(22) Filed: Apr. 30, 2015

(65) Prior Publication Data

US 2016/0118022 A1 Apr. 28, 2016

(30) Foreign Application Priority Data

Oct. 24, 2014 (KR) ..... 10-2014-0144635

(51) Int. Cl.

| | |
|---|---|
| ***G09G 3/32*** | (2016.01) |
| ***G09G 3/3225*** | (2016.01) |
| ***G09G 3/20*** | (2006.01) |

(52) U.S. Cl.

CPC ..... *G09G 3/3225* (2013.01); *G09G 3/2007* (2013.01); *G09G 2320/029* (2013.01); *G09G 2320/0276* (2013.01); *G09G 2360/16* (2013.01)

(58) Field of Classification Search

CPC ..... G09G 3/3225; G09G 3/2007; G09G 2320/029; G09G 2320/0276; G09G 2360/16

See application file for complete search history.

(56) References Cited

U.S. PATENT DOCUMENTS

| | | | | |
|---|---|---|---|---|
| 2004/0113875 | A1* | 6/2004 | Miller | G09G 3/3216 345/82 |
| 2007/0152934 | A1* | 7/2007 | Maeda | G09G 3/3233 345/92 |
| 2014/0062989 | A1* | 3/2014 | Ebisuno | G09G 3/3241 345/212 |

FOREIGN PATENT DOCUMENTS

| | | | |
|---|---|---|---|
| KR | 10-2013-0050083 | A | 5/2013 |
| KR | 10-2013-0134191 | A | 12/2013 |
| KR | 10-2013-0142748 | A | 12/2013 |
| KR | 10-2015-0039996 | | 4/2015 |

* cited by examiner

*Primary Examiner* — Liliana Cerullo

(74) *Attorney, Agent, or Firm* — Lee & Morse, P.C.

(57) ABSTRACT

A data signal processing device includes a load calculator and a compensation processor. The load calculator calculates an on-pixel rate (OPR) based on image data signals and positional weight values. The positional weight values are determined based on locations of pixels in a display panel. The OPR is proportional to a frame luminance load, which corresponds to a sum of driving currents for the pixels to emit light in each of a plurality of frames. The compensation processor compensates distorted luminance caused by the frame luminance load based on the OPR.

12 Claims, 4 Drawing Sheets

DATA SIGNAL PROCESSING DEVICE AND DISPLAY DEVICE HAVING THE SAME

CROSS-REFERENCE TO RELATED APPLICATION

Korean Patent Application No. 10-2014-0144635, filed on Oct. 24, 2014, and entitled, "Data Signal Processing Device and Display Device Having the Same," is incorporated by reference herein in its entirety.

BACKGROUND

1. Field

One or more embodiments described herein relate a data signal processing device and a display device having a data signal processing device.

2. Description of the Related Art

An ideal power supply supplies unlimited current and constant voltage throughout an entire range of the supply current. However, in an actual case, a power supply may operate as an ideal supply only in a certain range of supply current. This may present problems when the power supply is used for an electronic device such as a display device.

For example, the pixels in a display device generate light based on current from a power supply. However, since the power supply does not operate in an ideal manner, the amount of current supplied to each pixel may change as the total amount of driving current required for all pixels to emit light in each frame changes. For example, when the display device displays a relatively bright image in one frame compared to other frames, the amount of current supplied to each pixel may change because the load of the power supply increases. As a result, pixel luminance may change, and thus color coordinates may be distorted.

SUMMARY

In accordance with one or more embodiments, a data signal processing device includes a load calculator to calculate an on-pixel rate (OPR) based on image data signals and positional weight values, the positional weight values to be determined based on locations of pixels in a display panel, the OPR proportional to a frame luminance load which corresponds to a sum of driving currents for the pixels to emit light in each of a plurality of frames; and a compensation processor to compensate a distorted luminance caused by the frame luminance load based on the OPR. The positional weight values may be determined based on a voltage drop of a power voltage supplied to the pixels. The positional weight values may increase as the voltage drop decreases, and the positional weight values may decrease as the voltage drop increases.

The pixels may include sample pixels and common pixels, and the voltage drop may be determined based on a measured value of the power voltage measured from the sample pixels and an estimated value of the power voltage which is calculated from the common pixels by interpolation based on the measured value. The positional weight value of a first pixel may be greater than the positional weight value of a second pixel, and the first pixel may be closer to a power supply than the second pixel. The power supply may supply the power voltage from one side of the display panel, and the first pixel may be closer to the one side of the display panel than the second pixel.

The load calculator may calculate the OPR based on color weight values according to color of light to be emitted from the pixels. The color weight value of a first pixel may be greater than the color weight value of a second pixel that consumes less driving current than the first pixel, to emit light having a same luminance. The first pixel may be a blue, green, or red light emitting pixel. The second pixel may be a white light emitting pixel, and the first pixel may be a red, green, or blue light emitting pixel.

The OPR may be calculated based on the following equation:

$$OPR = \frac{\sum_{k=1}^{n}\left(\sum_{l=1}^{m}((RData(k,l)\times \mathrm{cr_r} + GData(k,l)\times \mathrm{cr_g} + BData(k,l)\times \mathrm{cr_b})\times \mathrm{loc_w}(k,l)/3)\right)}{(\mathrm{cr_r}+\mathrm{cr_g}+\mathrm{cr_b})\times avg(\mathrm{loc_w})\times n\times m},$$

where n is a number of columns of the display panel, m is a number of rows of the display panel, RData is an image data signal corresponding to a grayscale value of red light, GData is an image data signal corresponding to a grayscale value of green light, BData is an image data signal corresponding to a grayscale value of blue light, loc_w is the positional weight value, avg(loc_w) is an average value of the positional weight value, cr_r is the color weight value of a red light emitting pixel, cr_g is the color weight value of a green light emitting pixel, and cr_b is the color weight value of a blue light emitting pixel.

The image data signals may be gamma signals having target luminance corresponding to grayscale values of light to be emitted by the pixels according to a gamma setting. The data signal processing device may include a gamma processor to generate the gamma signals based on an input data signal. The compensation processor may include a data gap calculator to calculate data gaps between the OPR and the gamma signals; factor determination logic to determine compensation factors based on the data gaps; and a gamma signal compensator to multiply the gamma signals by the compensation factors. The factor determination logic may determine the compensation factors based on a look up table.

In accordance with one or more other embodiments, a data signal processing device includes a load calculator to calculate an on-pixel rate (OPR) based on image data signals and color weight values determined by color of light emitted from pixels on a display panel, the OPR proportional to a frame luminance load which corresponds to a sum of driving currents for the pixels to emit light in each of a plurality of frames; and a compensation processor to compensate a distorted luminance caused by the frame luminance load based on the OPR. The color weight value of a first pixel may be greater than the color weight value of a second pixel that consumes less driving current than the first pixel to emit light having a same luminance. The first pixel may be a blue, green, or red light emitting pixel. The second pixel may be a white light emitting pixel, and the first pixel may be a red, green, or blue light emitting pixel.

In accordance with one or more other embodiments, a display device includes a display panel with pixels; a display panel driver to drive the display panel; and a timing controller to control the display panel driver, wherein the timing controller has a data signal processor which includes: a load calculator to calculate an on-pixel rate (OPR) based on image data signals and positional weight values determined based on locations of the pixels in the display panel, the OPR proportional to a frame luminance load which corresponds to a sum of driving currents for the pixels to emit light in each of a plurality of frames; and a compensation processor to compensate distorted luminance caused by the frame luminance load based on the OPR.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
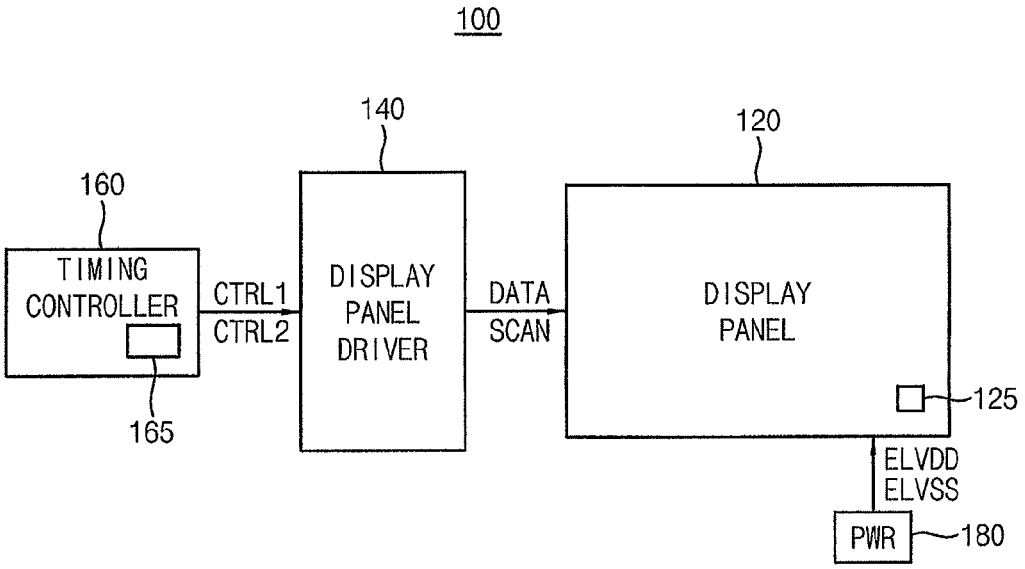
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

FIG. 1 illustrates an embodiment of a display device 100 which includes a display panel 120, a display panel driver 140, and a timing controller 160. The display device 100 includes a power supply 180. The display panel 120 includes a plurality of pixels 125. The timing controller 160 includes a data signal processing device 165. Although the data signal processing device 165 is in the timing controller 160 in FIG. 1, the data signal processing device 165 may be implemented independently and/or separately from (e.g., outside of) the timing controller 160 in another embodiment.

The pixels 125 receive a data signal DATA in an activation period of a scan signal SCAN. The pixels 125 receive power voltages EVLDD and EVLSS. The pixels 125 emit light based on the data signal DATA and the power voltages ELVDD and ELVSS. When the display device 100 is an organic light emitting display device, the pixels control a driving current based on the data signal DATA and the power voltages ELVDD and ELVSS. An organic light emitting diode in each of the pixels 125 emit light based on the driving current. Light emitted from the pixels generate an image.

The display panel driver 140 drives the display panel 120. The display panel driver 140 may generate the scan signal SCAN and the data signal DATA based on control signals CTRL1 and CTRL2 from the timing controller 160. As a result, the display panel driver 140 supplies the data signal DATA to a target pixel among the pixels 125. In one example embodiment, the display panel driver 140 includes a scan driver that generates the scan signal SCAN and a data driver that generates the data signal DATA.

The timing controller 160 controls the display panel driver 140. The timing controller 160 may control operation of the display panel driver 140 based on the control signals CTRL1 and CTRL2. The timing controller 160 may include the data signal processing device 165.

The data signal processing device 165 includes a load calculator and a compensation processor. The load calculator calculates an on-pixel rate (OPR) based on image data signals and a positional weight value determined based on locations of the pixels 125 in the display panel 120. The OPR is proportional to frame luminance load. The frame luminance load may correspond to a sum of driving currents for the pixels to emit light in each frame.

In one example embodiment, the positional weight value may be determined based on a voltage drop of the power voltages ELVDD and ELVSS supplied to the pixels 125. The positional weight value may increase as the voltage drop decreases, and the positional weight value may decrease as the voltage drop increases.

Ideally, voltage levels of the power voltages ELVSS and ELVDD supplied to a pixel 125 are the same as voltage levels of the power voltages ELVSS and ELVDD supplied to another pixel 125. However, a voltage drop phenomenon caused by resistance of the conducting wires that supply the power voltages ELVDD and ELVSS may occur. Because of this resistance, pixels 125 at different locations may receive substantially different power voltages. As a result, the pixels 125 may consume substantially different amounts of driving current under the same conditions.

In accordance with one embodiment, when calculating the frame luminance load, the load calculator may calculate the OPR based on one or more positional weight values that reflect the voltage drop phenomenon for the power voltages ELVDD and ELVSS.

The positional weight value of a first pixel may be larger than the positional weight value of a second pixel, when the first pixel is closer to the power supply 180 than the second pixel. The first pixel may be connected to the power supply 180 by a relatively short section of conducting wire, which therefore has relatively low resistance. The second pixel may be connected to the power supply 180 by a relatively longer section of conducting wire, which therefore has relatively greater resistance. Thus, a first voltage drop of the first pixel may be less than a second voltage drop of the second pixel. As a result, a first driving current consumed by the first pixel may be greater than a second driving current consumed by the second pixel.

To account for this situation, the first positional weight value at the first pixel may be greater than the second positional weight value at the second pixel. The load calculator may multiply the first positional weight value (i.e., a relatively large value) by a first image data signal of the first pixel, and may multiply the second positional weight value (i.e., a relatively small value) by a second image data signal of the second pixel. As a result, the load calculator may correctly calculate the OPR.

In one example embodiment, the power supply 180 may supply the power voltages ELVDD and EVLSS from one side of the display panel 120, and the first pixel may be closer to the one side of the display panel 120 than the second pixel.

In one example embodiment, the pixels 125 may include sample pixels and common pixels. The voltage drop may be determined according to a measured value of the power voltages ELVDD and ELVSS and an estimated value of the power voltages ELVDD and ELVSS. The measured value of the power voltages ELVDD and ELVSS may be measured from the sample pixels. The estimated value of the power voltages ELVDD and ELVSS may be calculated from the common pixels, for example, by interpolation based on the measured value. In one example embodiment, the estimated value of the power voltages ELVDD and ELVSS may be calculated by a linear interpolation. In another example embodiment, the estimated value of the power voltages ELVDD and ELVSS may be calculated by nonlinear interpolation.

In one example embodiment, the load calculator calculates the OPR based on a color weight value according to the color of light to be emitted from the pixels 125. Under the same conditions, the amount of a driving current consumed by the pixels 125 may be different according to color of light to be emitted from the pixels 125. Thus, when calculating the frame luminance load, the load calculator may calculate the OPR according to the color weight value in order to reflect a difference of the driving currents consumed by the pixels 125. In one embodiment, the color weight value of the first pixel may be greater than the color weight value of a second pixel that consumes a less driving current than the first pixel to emit light having the same luminance.

In one example embodiment, the first pixel may be a blue light emitting pixel and the second pixel may be a red or green light emitting pixel. The amount of the driving current consumed by the blue light emitting pixel may be relatively large because the efficiency of the blue light emitting pixel may be lower than an efficiency of each of the red and green light emitting pixels.

In another example embodiment, the second pixel may be a white light emitting pixel. In addition, the first pixel may be a red light emitting pixel, a green light emitting pixel, or a blue light emitting pixel. In a color filter-type organic light emitting display device, the amount of driving current consumed by the white light emitting pixel may be relatively small because the efficiency of the white light emitting pixel (on which no color filter is disposed) is higher than the efficiency of the red light emitting pixel on which a red color filter is disposed, the green light emitting pixel on which a green color filter is disposed, or the blue light emitting pixel on which a blue color filter is disposed.

In one example embodiment, the OPR may be calculated based on Equation 1:

$$OPR = \frac{\sum_{k=1}^{n}\left(\sum_{l=1}^{m}((RData(k,l)\times \mathrm{cr_r} + GData(k,l)\times \mathrm{cr_g} + BData(k,l)\times \mathrm{cr_b})\times \mathrm{loc_w}(k,l)/3)\right)}{(\mathrm{cr_r}+\mathrm{cr_g}+\mathrm{cr_b})\times avg(\mathrm{loc_w})\times n\times m} \quad (1)$$

where OPR is the on-pixel rate, n is the number of columns of the display panel, in is the number of rows of the display panel, RData is an image data signal corresponding to a red light grayscale value, GData is an image data signal corresponding to a green light grayscale value, BData is an image data signal corresponding to a blue light grayscale value, loc_w is the positional weight value, avg(loc_w) is an average of the positional weight value, cr_r is the color weight value of the red light emitting pixel, cr_g is the color weight value of the green light emitting pixel, cr_b is the color weight value of the blue light emitting pixel.

In one example embodiment, the data signal processing device 165 includes a gamma processor which generates gamma signals based on an input data signal. The image data signals may be the gamma signals having target luminance corresponding to grayscale values of light emitted by the pixels 125 according to a gamma setting.

The compensation processor may compensate luminance that is distorted by the frame luminance load based on the OPR. In one example embodiment, the compensation processor includes a data gap calculator, factor determination logic, and a gamma signal compensator. The data gap calculator calculates data gaps between the OPR and the gamma signals. The factor determination logic determines compensation factors based on the data gaps. The gamma signal compensator multiplies the gamma signals by the compensation factors. As a result, the gamma signal compensator compensates luminance distorted by the frame luminance load, since the gamma signal compensator multiplies the gamma signals by the compensation factors.

In one example embodiment, the factor determination logic determines the compensation factors based on a look up table (LUT). The LUT includes the compensation factors corresponding to the data gaps. Thus, the factor determination logic may determine one compensation factor corresponding to one data gap based on the LUT.

As a result, the present embodiment of the display device 100 may improve image quality using the data signal processing device, that compensates distortion caused by frame luminance load based on an OPR calculated using one or more positional weight values and one or more color weight values.

Figure 2:
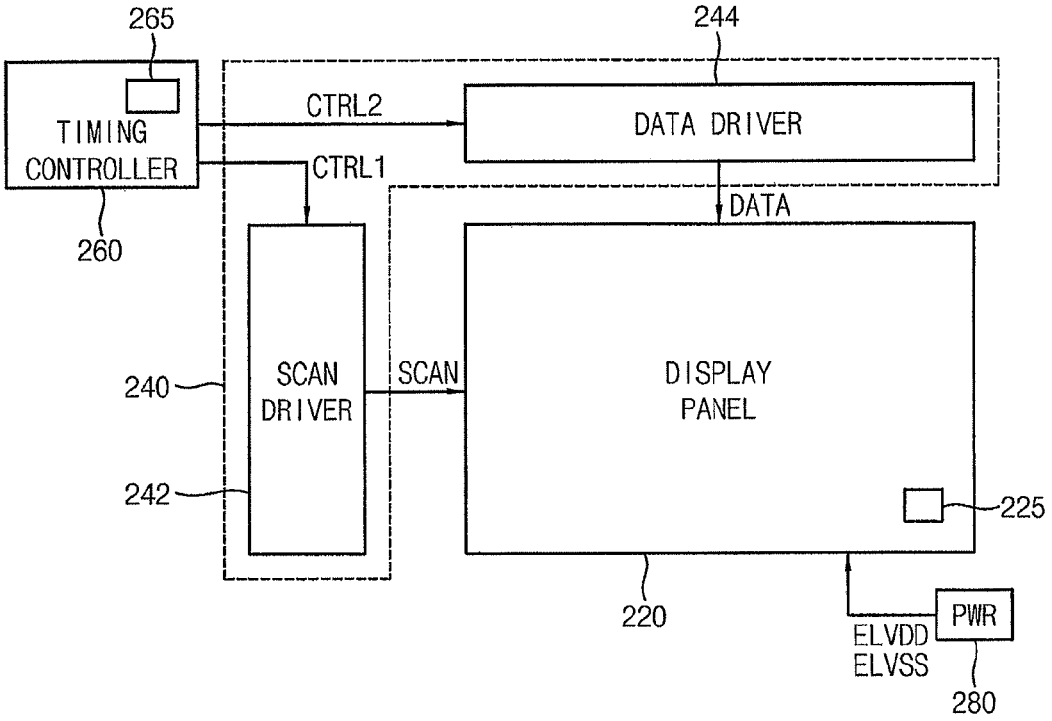
FIG. 2 illustrates another embodiment of a display device.

FIG. 2 illustrating a more detailed embodiment of a display device 200. Referring to FIG. 2, the display device 200 includes a display panel 220, a display panel driver 240, a timing controller 260, and a power supply 280. The display panel 220 includes a plurality of pixels 225. The display panel driver 240 includes a scan driver 242 and a data driver 244. The timing controller includes a data signal processing device 265.

The scan driver 242 generates a scan signal SCAN based on a first control signal CTRL1. The data driver 244 generates data signals DATA based on a second control signal CTRL2. The pixels 225 receive the data signals DATA during an activation period of the scan signal SCAN. Thus, the display panel driver 240 may supply the data signal DATA to a target pixel among the pixels 225. The pixels 225 emit light based on the data signals DATA and the power voltages ELVDD and ELVSS. The display device 200 may, for example, be a more detailed version of the display device 100.

Figure 3:
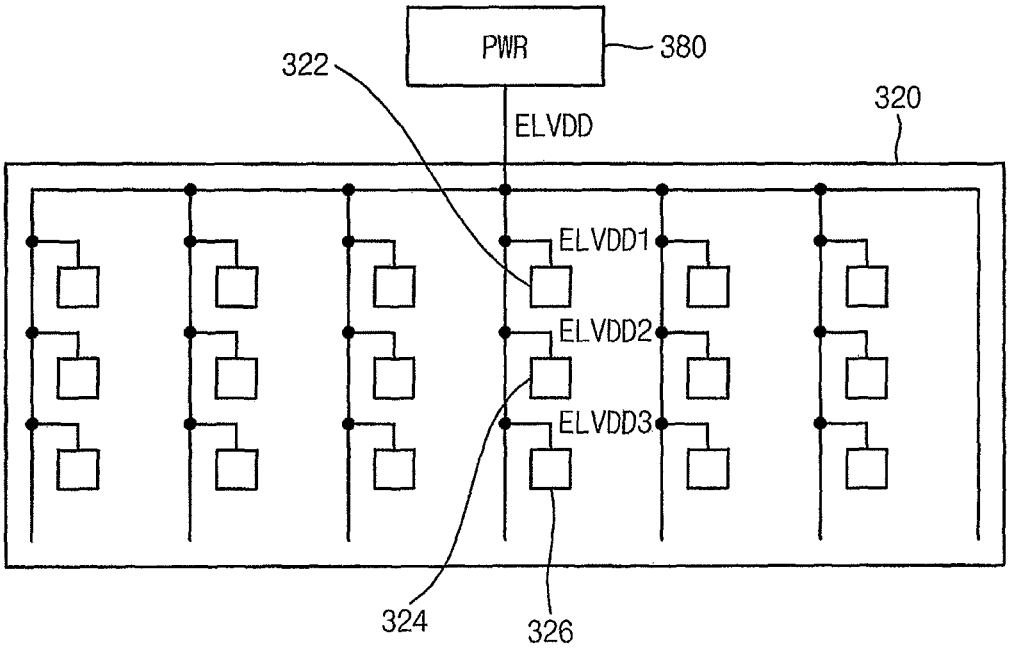
FIG. 3 illustrates an embodiment for changing the power voltage of pixels.

FIG. 3 illustrates an example in which a power voltage supplied to pixels in the display device 100 of FIG. 1 is changed based on locations of the pixels in the display panel. Referring to FIG. 3, the display device 100 includes the display panel 320 and a power supply 380. The display panel 320 includes a plurality of pixels 322, 324, and 326.

The power supply 380 supplies the power voltage ELVDD to the display panel 320. Ideally, the voltage level of the power voltage ELVDD supplied to a pixel 322 is same as the voltage levels of the power voltages ELVDD supplied to pixels 324 and 326. However, this may not be so in an actual case because of a voltage drop phenomenon. In a voltage drop phenomenon, resistance of conducting wires cause differences in the power voltage ELVDD received by the pixels. For example, the pixels 322, 324, and 326 may receive substantially different power voltages ELVDD1, ELVDD2, and ELVDD3 caused by the voltage drop phenomenon. Thus, the pixels 322, 324 and 326 may consume substantially different driving currents under the same conditions.

In accordance with one embodiment, when calculating a frame luminance load, a load calculator calculates on-pixel rate (OPR) based on positional weight values reflecting the voltage drop phenomenon in the power voltage ELVDD.

For example, the positional weight value of a first pixel 322 may be larger than the positional weight value of a second pixel 324, when the first pixel 322 is closer to the power supply 380 than the second pixel 324. The positional weight value of the second pixel 324 may be larger than the positional weight value of a third pixel 326, when the second pixel 324 is closer to the power supply 380 than the third pixel 326. The first pixel 322 is connected to the power supply 380 by a relatively short conducting wire, which has relatively low resistance. The second pixel 324 is connected to the power supply 380 by a relatively longer conducting wire, which has relatively greater resistance. Thus, the first voltage drop ELVDD-ELVDD1 of the first pixel 322 may be less than a second voltage drop ELVDD-ELVDD2 of the second pixel 324.

As a result, the first driving current consumed by the first pixel 322 may be larger than a second driving current consumed by the second pixel 324. Therefore, a first positional weight value at the first pixel 322 may be greater than a second positional weight value at the second pixel 324. The load calculator may multiply the first positional weight value (e.g., a relatively large value) by a first image data signal of the first pixel 322, and may multiply the second positional weight value (e.g., a relatively small value) by a second image data signal of the second pixel 324. As a result, the load calculator may correctly calculate the OPR.

In one example embodiment, the power supply 380 may supply power voltage ELVDD from one side of the display panel 320. For example, the power supply 380 may supply the power voltage ELVDD from a top side of the display panel 320 in FIG. 3. The first pixel 322 may be closer to the one side of the display panel 320 than the second pixel 324.

Figure 4:
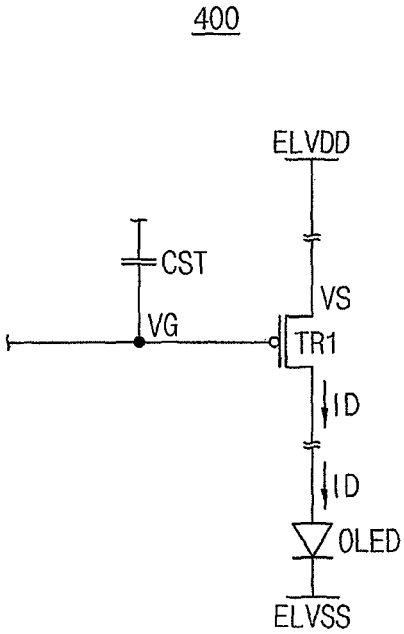
FIG. 4 illustrates an embodiment of a pixel.

FIG. 4 illustrates an example of a pixel 400, which, for example, may correspond to the pixels in the display device of FIG. 1. Referring to FIG. 4, the pixel 400 includes a driving transistor TR1, a storage capacitor CST, and an organic light emitting diode OLED. The driving transistor TR1 controls a driving current ID based on a difference between a source voltage VS and a gate voltage VG. The storage capacitor CST maintains the gate voltage VG of the driving transistor TR1 while the organic light emitting diode OLED emits light. The organic light emitting diode OLED emits light based on the driving current ID.

The pixel 400 receives a first power voltage ELVDD and a second power voltage ELVSS. The source voltage VS of the driving transistor TR1 may change as the first power voltage ELVDD changes. Generally, the source voltage VS may increase as a voltage level of the first power voltage ELVDD increases, and the source voltage VS may decrease as the voltage level of the first power voltage ELVDD decreases. Therefore, a voltage difference between the source voltage VS and the gate voltage VG may decrease as the voltage level of the first power voltage ELVDD decrease due to an increase in voltage drop. As a result, the amount of the driving current ID controlled by the driving transistor TR1 may decrease.

Figure 5:
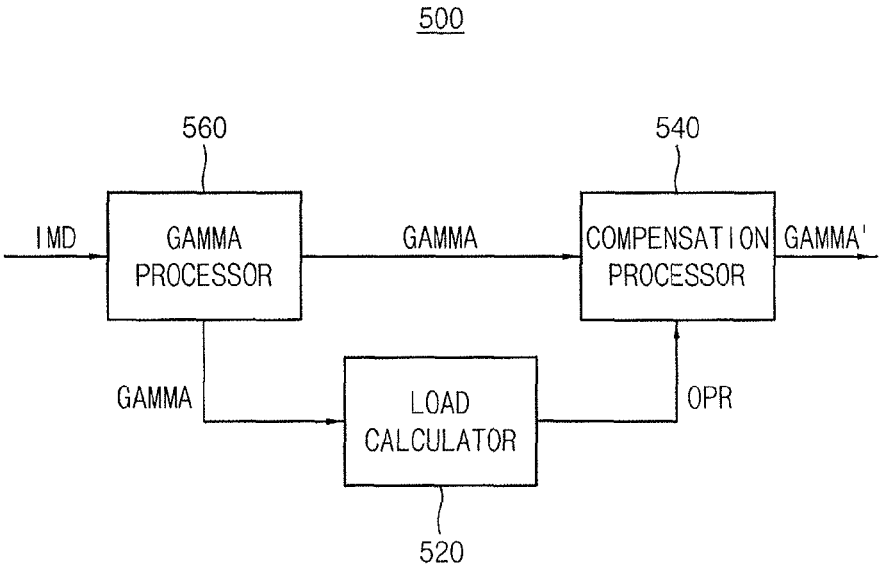
FIG. 5 illustrates an embodiment of a data signal processing device.

FIG. 5 illustrates an embodiment of a data signal processing device 500 which includes a load calculator 520 and a compensation processor 540. According to one example embodiment, the data signal processing device 500 may include a gamma processor 560.

The load calculator 520 calculates an on-pixel rate (OPR) based on image data signals and a positional weight value determined based on locations of the pixels 125 in the display panel. The OPR is proportional to frame luminance load. The frame luminance load may correspond to a sum of driving currents for the pixels to emit light in each frame.

In one example embodiment, the image data signals may be gamma signals GAMMA having target luminance corresponding to grayscale values of light to be emitted by the pixels according to a gamma setting. For example, one of the input image signals IMD may have a grayscale value of 203 from 8-bit grayscales. A generated gamma signal may have a target luminance of 100 nit corresponding to the grayscale value of 203, instead of the grayscale value of 203 according to a pre-set gamma setting, when the grayscale value of 203 responds to the target luminance of 100 nit. In one example embodiment, the gamma processor 560 generates the gamma signals GAMMA based on the input image signal IMD.

In one example embodiment, the positional weight value may be determined based on a voltage drop of the power voltage supplied to the pixels. The positional weight value may increase as the voltage drop decreases, and the positional weight value may decrease as the voltage drop increases. Ideally, voltage level of the power voltage supplied to a pixel is the same as voltage level of the power voltage supplied to another pixel. However, a voltage drop phenomenon resulted from the resistance of the conducting wires supplying the power voltage may occur. For example, the pixels may receive substantially different power voltages. Thus, the pixels may consume substantially different driving currents under the same conditions.

In accordance with one example embodiment, the load calculator 520 calculates OPR based on the positional weight value for reflecting the voltage drop phenomenon on the power voltages when calculating the frame luminance load. For example, the positional weight value of a first pixel may be greater than the positional weight value of a second pixel when the first pixel is closer to the power supply than the second pixel. The first pixel is connected to the power supply by a relatively short section of conducting wire, which has relatively low resistance. The second pixel is connected to the power supply by a relatively long section of conducting wire, which has relatively high resistance. Thus, a first voltage drop of the first pixel may be less than a second voltage drop of the second pixel.

As a result, a first driving current consumed by the first pixel may be greater than a second driving current consumed by the second pixel. Therefore, the first positional weight value at the first pixel may be greater than the second positional weight value at the second pixel. The load calculator 520 may multiply the first positional weight value (e.g., a relatively large value) by a first image data signal of the first pixel and may multiply the second positional weight value (e.g., a relatively small value) by a second image data signal of the second pixel. As a result, the load calculator 520 may correctly calculate the OPR.

In one example embodiment, the power supply may supply the power voltage from one side of the display panel, and the first pixel may be closer to the one side of the display panel than the second pixel.

In one example embodiment, the pixels may include sample pixels and common pixels. The voltage drop may be determined according to a measured value of the power voltage and an estimated value of the power voltage. The measured value of the power voltage may be measured from the sample pixels. The estimated value of the power voltage may be calculated from the common pixels, for example, by interpolation based on the measured value. In one example embodiment, the estimated value of the power voltage may be calculated, for example, by linear interpolation. In another example embodiment, the estimated value of the power voltage may be calculated by nonlinear interpolation.

In one example embodiment, the load calculator 520 may calculate the OPR based on a color weight value according to color of light emitted from the pixels. Under the same conditions, the amount of driving current consumed by the pixels may be different according to color of light emitted from the pixels. Thus, the load calculator may calculate the OPR according to the color weight value for reflecting a difference of the driving currents consumed by the pixels when calculating the frame luminance load. Therefore, the color weight value of a first pixel may be greater than the color weight value of a second pixel that consumes less driving current than the first pixel to emit light having the same luminance.

In one example embodiment, the first pixel may be a blue light emitting pixel and the second pixel may be a red or green light emitting pixel. Generally, the amount of driving current consumed by the blue light emitting pixel may be relatively large because the efficiency of the blue light emitting pixel is less than the efficiency of each of the red and green light emitting pixels.

In another example embodiment, the second pixel may be a white light emitting pixel and the first pixel may be a red light emitting pixel, a green light emitting pixel, or a blue light emitting pixel. In a color filter type organic light emitting display device, the amount of driving current consumed by the white light emitting pixel may be relatively small. This is because the efficiency of the white light emitting pixel (on which no color filter is disposed) is relatively higher than the efficiencies of one or more of the red, green, or blue light emitting pixels. In one example embodiment, the OPR may be calculated based on Equation 1.

The compensation processor 540 compensates luminance distorted by the frame luminance load based on the OPR. In one example embodiment, the compensation processor 540 may include a data gap calculator, factor determination logic, and a gamma signal compensator. As a result, the luminance of light emitted from the pixels and color coordinates may not be distorted. This is because the data signal processing device 500 compensates distortion, that otherwise would occur by the frame luminance load, based on the OPR that is calculated using the positional weight value and the color weight value.

Figure 6:
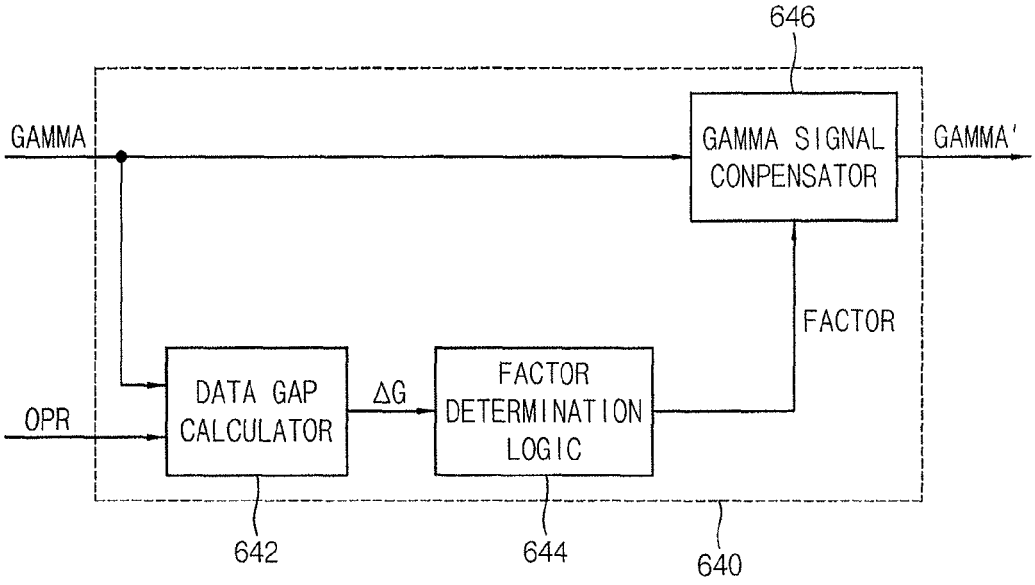
FIG. 6 illustrates an embodiment of a compensation processor.
Figure 7:
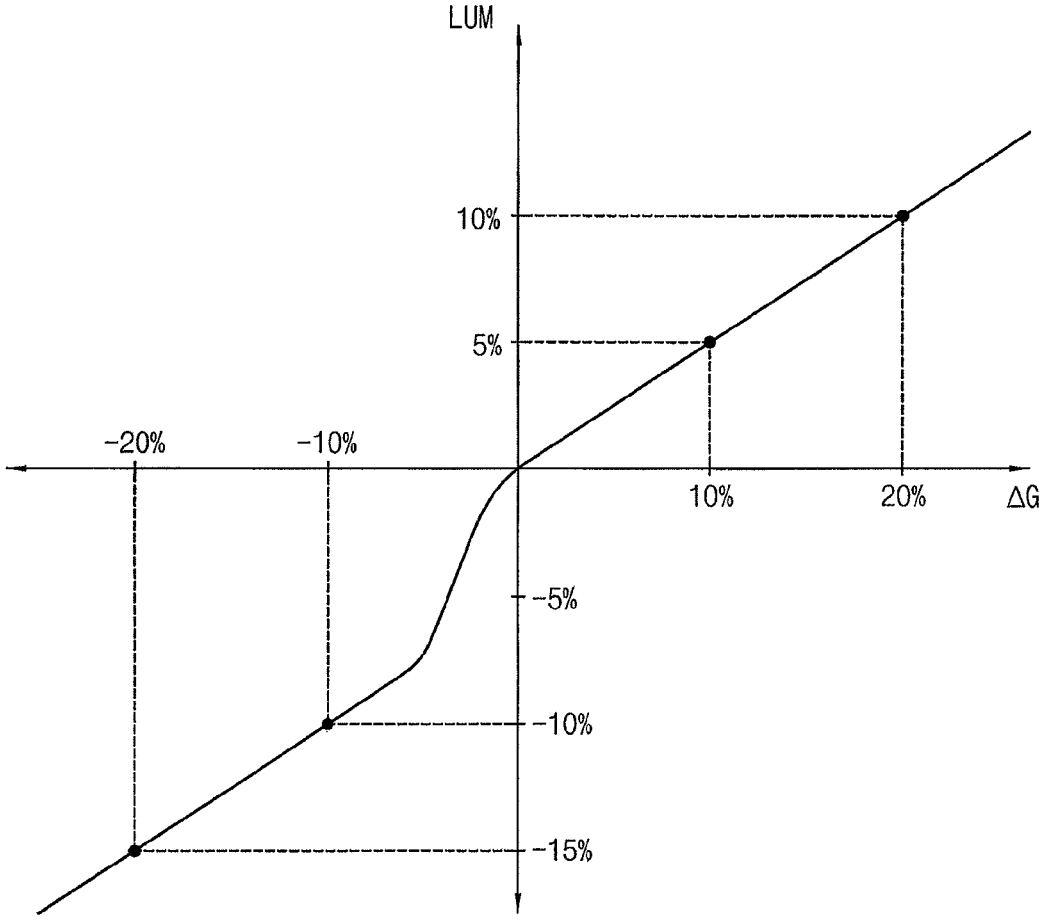
FIG. 7 illustrates an example of luminance distortion caused by data gaps between an on-pixel rate and gamma signals.

FIG. 6 illustrates an example of a compensation processor 640 in the data signal processing device of FIG. 5. FIG. 7 illustrates an example of luminance distortion caused by data gaps between on-pixel rate and gamma signals. Referring to FIGS. 6 and 7, the compensation processor 640 includes a data gap calculator 642, factor determination logic 644, and a gamma signal compensator 646.

The data gap calculator 642 calculates the data gaps ΔG between the OPR and the gamma signals. For example, the data gap may be about 10% of the OPR when the OPR is 100. The gamma signal may have a data value of 110 for a target luminance of 100 nit.

The factor determination logic 644 determines compensation factors FACTOR based on the data gaps ΔG. As illustrated in FIG. 7, the luminance of light emitted from a pixel may increase about 5% according to a frame luminance load when the data gap is about 10%. In this case, the factor determination logic 644 may determine the compensation factor to decrease luminance by about 5%. The compensation factor, for example, may be 0.95.

In one example embodiment, the factor determination logic 644 determines the compensation factors FACTOR based on a look up table (LUT). The LUT may provide the compensation factors FACTOR in correspondence with the data gaps ΔG. Thus, the factor determination logic 644 may determine one compensation factor corresponding to one data gap based on the LUT. For example, the LUT may include a compensation factor of 0.9 corresponding to a data gap of 20%, and a compensation factor of 1.1 corresponding to a data gap of −10%. The factor determination logic 644 may determine the compensation factors based on the LUT.

The gamma signal compensator 646 generates compensated gamma signals GAMMA' by multiplying the gamma signals by the compensation factors FACTOR. As a result, the gamma signal compensator 646 may compensate luminance that is distorted by the frame luminance load by multiplying the gamma signals GAMMA by the compensation factors FACTOR.

In one or more of the aforementioned embodiments, the pixels are described as including P-channel Metal Oxide Semiconductor (PMOS) transistors. In another embodiment, the pixels may include N-channel Metal Oxide Semiconductor (NMOS) transistors.

Also, the aforementioned embodiments may be applied to a variety of electronic devices that include or are coupled to a display device. Examples include a computer, a laptop, a digital camera, a digital camcorder, a cellular phone, a smart phone, a smart pad, a PMP, a PDA, an MP3 player, a navigation system, a video phone, a monitoring system, a tracking system, a motion detecting system, an image stabilization system, etc.

The processors, calculators, compensation and determination units, and the other processing or control features of the embodiments described herein may be implemented in logic which, for example, may include hardware, software, or both. When implemented at least partially in hardware, the processors, calculators, compensation and determination units, and the other processing or control features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the processors, calculators, compensation and determination units, and the other processing or control features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, when a display device displays a relatively bright image in one frame compared to other frames, the amount of current supplied to each of a plurality of pixels may change because of an increase in the load of a power supply. Consequently, the luminance of light emitted from the pixels may change and, thus, color coordinates may be distorted. In accordance with one or more of the aforementioned embodiments, a data signal processing device determines OPR based on a positional weight value relating to positional differences of the pixels and a color weight value for different driving currents by color of pixels. As a result, distortion of the luminance of light emitted from pixels and distortion of the color coordinates may be reduced or prevented, thereby improving display quality.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A data signal processing device, comprising:

a load calculation circuit to calculate an on-pixel rate (OPR) based on image data signals and positional weight values, the positional weight values to be determined based on locations of pixels in a display panel, the OPR proportional to a frame luminance load which corresponds to a sum of driving currents for the pixels to emit light in each of a plurality of frames; and a compensation processor to compensate a distorted luminance caused by the frame luminance load based on the OPR, wherein the positional weight values are determined according to amounts of voltage drops of a power voltage supplied to the pixels.

2. The device as claimed in claim 1, wherein:

the positional weight values increase as the voltage drop decreases, and the positional weight values decrease as the voltage drop increases.

3. The device as claimed in claim 1, wherein:

the positional weight value of a first pixel is greater than the positional weight value of a second pixel, and the first pixel is closer to a power supply than the second pixel.

4. The device as claimed in claim 3, wherein:

the power supply is to supply the power voltage from one side of the display panel, and the first pixel is closer to the one side of the display panel than the second pixel.

5. The device as claimed in claim 1, wherein the load calculation circuit is to calculate the OPR based on color weight values according to color of light to be emitted from the pixels.

6. The device as claimed in claim 5, wherein the color weight value of a first pixel is greater than the color weight value of a second pixel that consumes less driving current than the first pixel, to emit light having a same luminance.

7. The device as claimed in claim 6, wherein:

the first pixel is a blue light emitting pixel, and the second pixel is a green, or red light emitting pixel.

8. The device as claimed in claim 6, wherein:

the second pixel is a white light emitting pixel, and the first pixel is a red, green, or blue light emitting pixel.

9. The device as claimed in claim 1, wherein the image data signals are converted into gamma signals having target luminance corresponding to grayscale values of light to be emitted by the pixels according to a gamma setting.

10. The device as claimed in claim 9, further comprising:

a gamma processor to generate the gamma signals based on an input data signal.

11. A data signal processing device, comprising:

a load calculation circuit to calculate an on-pixel rate (OPR) based on image data signals and positional weight values, the positional weight values to be determined based on locations of pixels in a display panel, the OPR proportional to a frame luminance load which corresponds to a sum of driving currents for the pixels to emit light in each of a plurality of frames; and a compensation processor to compensate a distorted luminance caused by the frame luminance load based on the OPR, wherein the OPR is calculated based on the following equation:

$$OPR = \frac{\sum_{k=1}^{n}\left(\sum_{l=1}^{m}((RData(k,l)\times \mathrm{cr_r} + GData(k,l)\times \mathrm{cr_g} + BData(k,l)\times \mathrm{cr_b})\times \mathrm{loc_w}(k,l)/3)\right)}{(\mathrm{cr_r}+\mathrm{cr_g}+\mathrm{cr_b})\times avg(\mathrm{loc_w})\times n\times m},$$

where n is a number of columns of the display panel, m is a number of rows of the display panel, RData is an image data signal corresponding to a grayscale value of red light, GData is an image data signal corresponding to a grayscale value of green light, BData is an image data signal corresponding to a grayscale value of blue light, loc_w is the positional weight value, avg(loc_w) is an average value of the positional weight value, cr_r is the color weight value of a red light emitting pixel, cr_g is the color weight value of a green light emitting pixel, and cr_b is the color weight value of a blue light emitting pixel.

12. A display device, comprising:

a display panel including a plurality of pixels;

a display panel driver to drive the display panel; and a timing controller to control the display panel driver, wherein the timing controller has a data signal processor which includes:

a load calculation circuit to calculate an on-pixel rate (OPR) based on image data signals and positional weight values determined based on locations of the pixels in the display panel, the OPR proportional to a frame luminance load which corresponds to a sum of driving currents for the pixels to emit light in each of a plurality of frames; and a compensation processor to compensate a distorted luminance caused by the frame luminance load based on the OPR, wherein the positional weight values are determined according to amounts of voltage drops of a power voltage supplied to the pixels.

* * * * *